United States Patent [19]

Merten et al.

[11] Patent Number: 4,852,837

[45] Date of Patent: Aug. 1, 1989

[54] REMOVABLE LEG ASSEMBLY

[75] Inventors: Barry Merten, Orchard Park; Gordon W. Kamman, Elma, both of N.Y.

[73] Assignee: The Quaker Oats Company, Chicago, Ill.

[21] Appl. No.: 762,133

[22] Filed: Aug. 2, 1985

[51] Int. Cl.[4] ..... F16M 11/16

[52] U.S. Cl. ..... 248/188; 108/156; 403/370

[58] Field of Search ..... 248/188, 188.1, 188.3, 248/188.4, 188.8, 412, 411, 316.2, 316.3, 151, 244, 245; 108/156, 107; 403/370, 374, 317

[56] References Cited

U.S. PATENT DOCUMENTS

| | | | |
|---|---|---|---|
| 1,244,865 | 10/1967 | Krohn | 403/370 X |
| 2,742,082 | 4/1956 | Lief | 248/412 |
| 3,134,566 | 5/1964 | Breene | 248/188 X |
| 3,604,369 | 9/1971 | Maslow | 248/188 X |
| 3,865,050 | 2/1975 | Cecchetti | 248/188 X |
| 4,011,821 | 3/1977 | Neal | 108/156 |
| 4,496,125 | 1/1985 | Walsh et al. | 248/188 |

*Primary Examiner*—Ramon O. Ramirez
*Attorney, Agent, or Firm*—Cumpston & Shaw

[57] ABSTRACT

A detachable leg assembly for an object includes a substantially cylindrical leg having a recess adjacent a first end thereof and a tapered leg-receiving chamber, larger than the cross-sectional area of the leg, having a locking projection on one wall thereof adapted to engage the recess when the leg is positioned in the chamber; a wedge-shaped holding member adapted, when positioned within the chamber, to substantially fill the space between the leg and the wall of the chamber; and means for anchoring the holding member in position.

16 Claims, 1 Drawing Sheet

REMOVABLE LEG ASSEMBLY

This invention relates in general to an assembly for joining a supporting leg to an object such as a table or chair and more particularly, to such an assembly that is adapted to be readily assembled and disassembled.

It is oftentimes desirable to provide a table or a chair with a removable supporting leg for reducing the size of the object during shipping or storage. It has been a persistent problem to provide such an assembly that rigidly joins the leg to the object, and is easy to assemble and inexpensive to manufacture. In the past, such assemblies have included a variety of flanges mounted to the leg and adapted to be bolted or otherwise fastened to the object; screw-in legs, braces and a variety of other complex structures, none of which have been completely satisfactory. Where simple systems have been used, the attachment of the leg has been less secure than desirable and the leg has tended to wobble.

Accordingly, it is an object of this invention to provide an assembly for joining a leg to an object that securely fastens the leg and the object together.

It is another object of this invention to provide such an assembly that is easy to assemble and does not require the use of special tools.

It is another object of this invention to provide such an assembly that is easy to manufacture and can be made largely from molded plastic components if desired.

Briefly stated and in accordance with a presently preferred embodiment of this invention, a detachable leg assembly includes a substantially cylindrical leg having a recess adjacent a first end thereof and a tapered leg-receiving chamber, larger than the cross-sectional area of the leg, having a locking projection on one wall thereof adapted to engage the recess when the leg is positioned in the chamber; and a wedge-shaped holding member adapted, when positioned within the chamber, to substantially fill the space between the leg and the wall of the chamber to hold the projection and recess in locking engagement; and means for anchoring the holding member in position.

These and other objects and advantages of the invention will become more readily apparent to those skilled in the art with reference to the following detailed description thereof taken in conjunction with the accompanying drawings in which.

Figure 1:
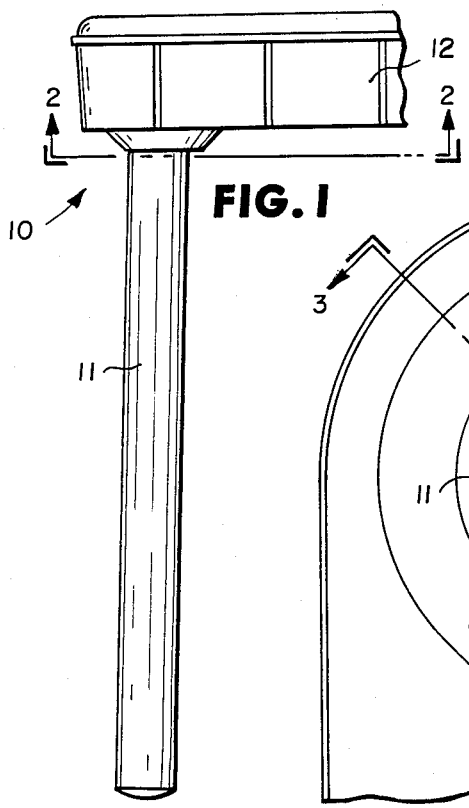
FIG. 1 is a side elevational view of an object including a leg assembly in accordance with this invention.

Referring now to FIG. 1, a portion of a table or chair or other object 10 including a leg assembly in accordance with this invention is illustrated. A substantially cylindrical leg 11 is joined to a supported object 12.

Figure 2:
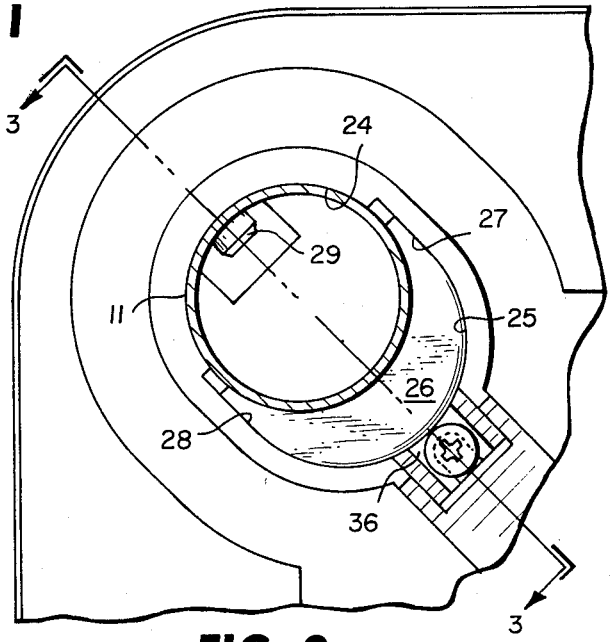
FIG. 2 is a section view taken along line 2—2 of FIG. 1.
Figure 3:
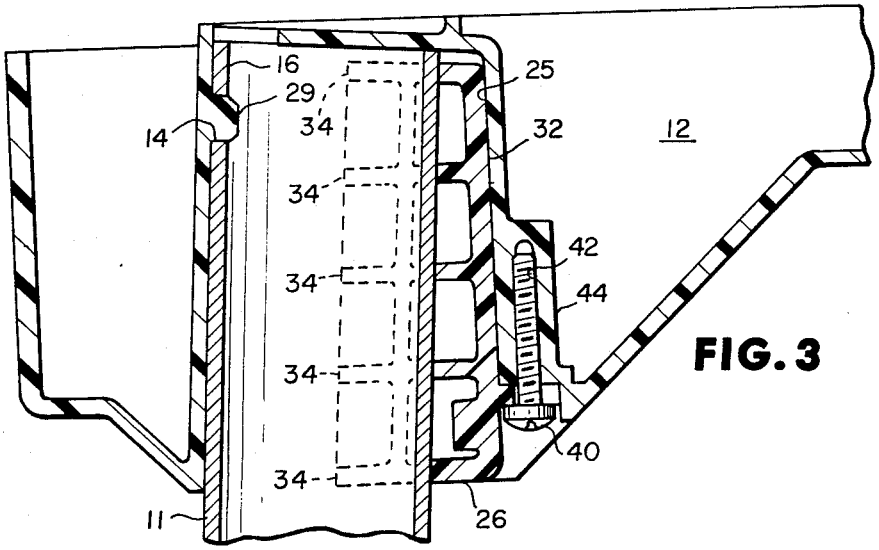
FIG. 3 is a section view taken along 3—3 of FIG. 2.

The structure of the assembly itself may be more clearly seen by referring to FIGS. 2 and 3. The assembly includes substantially tubular or slightly tapered leg 11 having a recess 14 adjacent an upper end 16 thereof. Recess 14 is preferably a substantially round hole extending through the wall of leg 11. The end 16 of leg 11 is received within a tapered chamber 20 having generally oval-shaped cross-section larger than the cross-section of the leg and including a substantially cylindrical wall portion 24 matching leg 11. Chamber 20 also includes a second opposed generally cylindrical wall portion 25 of larger radius than wall portion 24 and adapted to receive leg 11 during assembly.

Opposed curved wall portions 24 and 25 of chamber 20 are joined by substantially straight wall sections 27 and 28. A substantially cylindrical locking member 29 projects outwardly from wall 24 into chamber 20.

A tapered wedge 26 is disposed within chamber 20 between leg 11 and curved wall portion 25. In accordance with a presently preferred embodiment of this invention, wedge-shaped member 26 has substantially smooth curved outer surface portion 32 adapted to engage wall 25 of chamber 20 and a plurality of inwardly facing ribs 34, each rib having a curved inner surface and adapted to engage the outer surface of leg 11. Wedge 26 is preferably provided with an outwardly extending flange 36 having a notch therein and a bolt 40 is provided for fixing wedge 26 in position relative to the chamber and the leg.

A leg assembly in accordance with this invention is both easy to assemble and provides a very secure attachment between the leg and the table or chair or the like. Assembly of the elements of the invention proceeds as follows. The upper end 16 of leg 11 is inserted into tapered chamber 20 adjacent large diameter end 25. The leg is inserted completely into the chamber and is then moved laterally and tilted slightly until projection 29 engages recess 14 and the side of the upper portion of the leg is adjacent wall 24. Tapered wedge 26 is then inserted into the space between leg 11 and wall 25 and is secured within the chamber by screw 40 which is received in threaded cavity 42 of boss 44. Projection 29 prevents leg 11 from being withdrawn from the assembly and wedge 26 maintains a tight fit within chamber 20 and prevents the projection from becoming disengaged from recess 14.

Preferably, the supported portion 12 of table or chair 10 and particularly that portion that forms tapered chamber 20 is constructed of a durable plastic material, leg 11 is made of metal and wedge 26 is made of plastic material. In the alternative, tapered chamber 20 and leg 11 are both made of metal and wedge 26 is made of plastic material. In accordance with a still further embodiment of the invention, wedge 26 is made of metal or other rigid material and chamber 20 made from plastic material. Any of the above combinations or any other combination in which leg 11 is at least somewhat resiliently held by wedge 26 within tapered chamber 20 may be used.

While the invention has been described in connection with a presently preferred embodiment thereof, those skilled in the art will recognize that certain modifications and changes may be made without departing from the true spirit and scope of the invention, which accordingly, is intended to be defined solely by the appended claims.

What is claimed is:

1. A leg assembly for an object comprising:

a leg receiving chamber in said object;

a projection attached to said chamber;

a leg having a first end disposed within said chamber;

a recess formed in said leg adjacent the first end of said leg and engaging said projection;

a wedge disposed at least partially within said chamber for securing said leg therein with said recess engaging said projection; and means for fixing said wedge within said chamber.

2. The leg assembly of claim 1 wherein said leg receiving chamber is characterized by a substantially oval cross-section having a first end having a radius of curvature matching the leg and a second end having a larger radius of curvature.

3. A leg assembly for an object comprising:
a leg receiving chamber in said object;
a projection extending into said chamber;
a leg having a first end disposed within said chamber;
a recess formed in said leg and engaging said projection;
a wedge disposed at least partially within said chamber for securing said leg therein;
a boss attached to said wedge; and
means for anchoring said boss adjacent said chamber.

4. The leg assembly of claim 1 wherein said wedge comprises a tapered curved wedge having an inner concave surface matching the surface of said leg and an outer convex surface matching the inner surface of said chamber.

5. A leg assembly for an object comprising:
a leg receiving chamber in said object;
a projection extending into said chamber;
a leg having a first end disposed within said chamber;
a recess formed in said leg and engaging said projection;
a curved wedge having a curved surface portion engaging said chamber and a plurality of spaced apart ribs attached at one end to said surface portion and engaging said leg at the opposite end; and
means for fixing said wedge within said chamber.

6. The assembly of claim 2 wherein said projection comprises a generally cylindrical post attached at one end to said first end of said chamber.

7. Components for forming a leg assembly for an object comprising, in combination:
an elongated leg having a recess formed adjacent one end thereof;
a leg receiving chamber in said object adapted to loosely receive said leg;
a locking projection attached to said chamber adapted to engage said recess;
a locking wedge adapted to fit within said chamber for securing said leg therein in locking relationship with said projection; and
means for securing said wedge at least partially within said chamber adjacent said leg.

8. The components for forming a leg assembly according to claim 7 wherein said leg receiving chamber is characterized by a substantially oval cross-section having a first end having a radius of curvature matching the leg and a second end having a larger radius of curvature.

9. Components for forming a leg assembly for an object comprising, in combination:
an elongated leg having a recess formed adjacent one end thereof;
a leg receiving chamber in said object adapted to loosely receive said leg;
a locking projection within said chamber adapted to engage said recess;
a locking wedge adapted to fit within said chamber for securing said leg therein in locking relationship with said projection;
a boss attached to said wedge; and
means for anchoring said boss adjacent said chamber.

10. The components for forming a leg assembly according to claim 7 wherein said wedge comprises a tapered curved wedge having an inner concave surface matching the surface of said leg and an outer convex surface matching the inner surface of said chamber.

11. Components for forming a leg assembly for an object comprising, in combination:
an elongated leg having a recess formed adjacent one end thereof;
a leg receiving chamber in said object adapted to loosely receive said leg;
a locking projection within said chamber adapted to engage said recess;
a locking wedge comprising an outer convex curved surface portion engaging said chamber and a plurality of spaced apart ribs attached at one end to said surface portion and having concave opposite ends engaging said legs; and
means for securing said wedge at least partially within said chamber adjacent said leg.

12. A detachable leg assembly for an object comprising:
a substantially cylindrical leg having a recess adjacent a first end thereof;
a generally frustoconical leg receiving chamber formed in said object having a locking projection on one wall thereof adapated to engage said recess when said leg is positioned in said chamber; and
a wedge-shaped anchoring member positioned within said chamber and substantially filling the space between said leg and the wall of said chamber; and
means for anchoring said holding member in place within said chamber.

13. The leg assembly of claim 12 wherein said leg receiving chamber is characterized by a substantially oval cross-section having a first end having a radius of curvature matching the leg and a second end having a larger radius of curvature.

14. A detachable leg assembly for an object comprising:
a substantially cylindrical leg having a recess adjacent a first end thereof;
a generally frustoconical leg receiving chamber formed in said object having a locking projection on one wall thereof adapted to engage said recess when said leg is positioned in said chamber;
a wedge-shaped anchoring member positioned within said chamber and substantially filling the space between said leg and the wall of said chamber;
a boss attached to said wedge; and
means for anchoring said boss adjacent said chamber.

15. The leg assembly of claim 12 wherein said wedge comprises a tapered curved wedge having an inner concave surface matching the surface of said leg and an outer convex surface matching the inner surface of said chamber.

16. A detachable leg assembly for an object comprising:
a substantially cylindrical leg having a recess adjacent a first end thereof;
a generally frustoconical leg receiving chamber formed in said object having a locking projection on one wall thereof adapted to engage said recess when said leg is positioned in said chamber; a wedge comprising an outer convex curved surface portion engaging said chamber and a plurality of spaced apart ribs attached at one end to said surface portion and having concave opposite ends engaging said legs; and
means for anchoring said holding member in place within said chamber.

* * * * *

UNITED STATES PATENT AND TRADEMARK OFFICE

CERTIFICATE OF CORRECTION

PATENT NO. : 4,852,837

DATED : August 1, 1989

INVENTOR(S) : Barry Merten and Gordon W. Kamman

It is certified that error appears in the above—identified patent and that said Letters Patent is hereby corrected as shown below:

The title page should be deleted to appear as per attached title page.

Fig. 3 should appear as below.

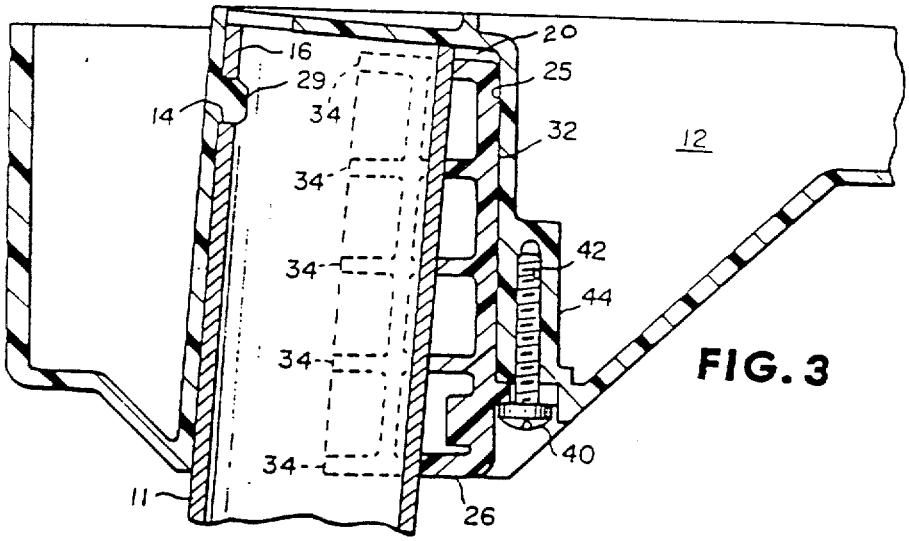

FIG. 3

Signed and Sealed this

Twenty-second Day of October, 1991

*Attest:*

HARRY F. MANBECK, JR.

*Attesting Officer*

*Commissioner of Patents and Trademarks*

United States Patent [19]

Merten et al.

[11] Patent Number: 4,852,837

[45] Date of Patent: Aug. 1, 1989

[54] REMOVABLE LEG ASSEMBLY

[75] Inventors: Barry Merten, Orchard Park; Gordon W. Kamman, Elma, both of N.Y.

[73] Assignee: The Quaker Oats Company, Chicago, Ill.

[21] Appl. No.: 762,133

[22] Filed: Aug. 2, 1985

[51] Int. Cl.[4] ..... F16M 11/16

[52] U.S. Cl. ..... 248/188; 108/156; 403/370

[58] Field of Search ..... 248/188, 188.1, 188.3, 248/188.4, 188.8, 412, 411, 316.2, 316.3, 151, 244, 245; 108/156, 107; 403/370, 374, 317

[56] References Cited

U.S. PATENT DOCUMENTS

| | | | |
|---|---|---|---|
| 1,244,865 | 10/1967 | Krohn | 403/370 X |
| 2,742,082 | 4/1956 | Lief | 248/412 |
| 3,134,566 | 5/1964 | Breene | 248/188 X |
| 3,604,369 | 9/1971 | Maslow | 248/188 X |
| 3,865,050 | 2/1975 | Cecchetti | 248/188 X |
| 4,011,821 | 3/1977 | Neal | 108/156 |
| 4,496,125 | 1/1985 | Walsh et al. | 248/188 |

*Primary Examiner*—Ramon O. Ramirez
*Attorney, Agent, or Firm*—Cumpston & Shaw

[57] ABSTRACT

A detachable leg assembly for an object includes a substantially cylindrical leg having a recess adjacent a first end thereof and a tapered leg-receiving chamber, larger than the cross-sectional area of the leg, having a locking projection on one wall thereof adapted to engage the recess when the leg is positioned in the chamber; a wedge-shaped holding member adapted, when positioned within the chamber, to substantially fill the space between the leg and the wall of the chamber; and means for anchoring the holding member in position.

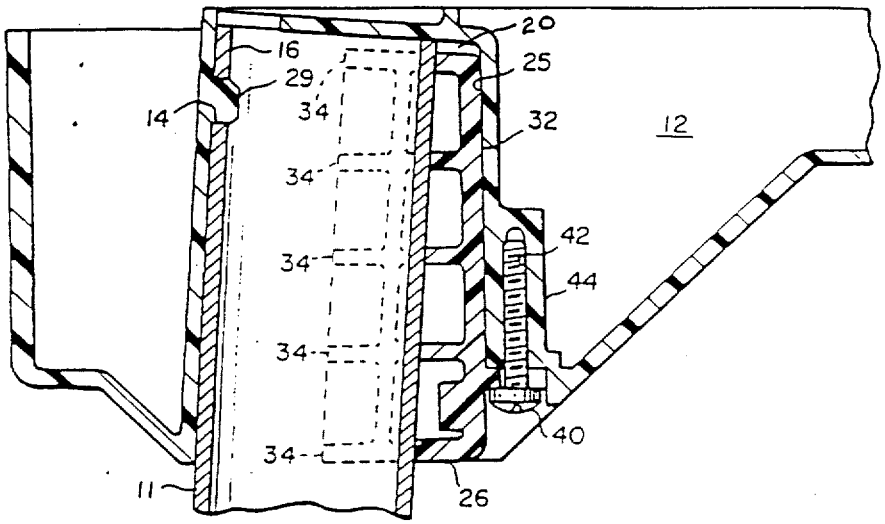

16 Claims, 1 Drawing Sheet